US009449603B2

(12) United States Patent
Virette et al.

(10) Patent No.: US 9,449,603 B2
(45) Date of Patent: Sep. 20, 2016

(54) MULTI-CHANNEL AUDIO ENCODER AND METHOD FOR ENCODING A MULTI-CHANNEL AUDIO SIGNAL

(71) Applicant: Huawei Technologies Co., Ltd., Shenzhen, Guangdong (CN)

(72) Inventors: David Virette, Munich (DE); Yue Lang, Beijing (CN); Jianfeng Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 179 days.

(21) Appl. No.: 14/498,613

(22) Filed: Sep. 26, 2014

(65) Prior Publication Data

US 2015/0049872 A1 Feb. 19, 2015

Related U.S. Application Data

(63) Continuation of application No. PCT/EP2012/056321, filed on Apr. 5, 2012.

(51) Int. Cl.
*G10L 19/008* (2013.01)
*G10L 19/02* (2013.01)

(52) U.S. Cl.
CPC ..... *G10L 19/008* (2013.01); *G10L 19/0204* (2013.01)

(58) Field of Classification Search
CPC ..... G10L 19/008; G10L 18/0204
USPC ..... 381/231–2, 17, 22, 97–98, 100; 704/500, 501, 503, 200.01, 278
See application file for complete search history.

(56) References Cited

U.S. PATENT DOCUMENTS

2005/0213522 A1 9/2005 Aarts et al.
2006/0083385 A1 4/2006 Allamanche et al.
(Continued)

FOREIGN PATENT DOCUMENTS

CN 101044551 A 9/2007
CN 101826326 A 9/2010
(Continued)

OTHER PUBLICATIONS

Schuijers et al, "Advances in Parametric Coding for High-Quality Audio," Presented at the 114th AES Convention, Convention Paper 5852, pp. 1-11, Audio Engineering Society, New York, New York (Mar. 22-25, 2003).
(Continued)

*Primary Examiner* — Melur Ramakrishnaiah
(74) *Attorney, Agent, or Firm* — Leydig, Voit & Mayer, Ltd.

(57) ABSTRACT

The invention relates to a method for determining an encoding parameter for an audio channel signal of a multi-channel audio signal, the method comprising: determining a frequency transform of the audio channel signal; determining a frequency transform of a reference audio signal; determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band the inter-channel difference is associated to; determining a first average based on positive values of the inter-channel differences and determining a second average based on negative values of the inter-channel differences; and determining the encoding parameter based on the first average and on the second average.

20 Claims, 7 Drawing Sheets

(56) References Cited

U.S. PATENT DOCUMENTS

| | | | | |
|---|---|---|---|---|
| 2006/0115100 | A1 | 6/2006 | Faller | |
| 2007/0036360 | A1* | 2/2007 | Breebaart | G10L 19/008 381/23 |
| 2007/0248157 | A1 | 10/2007 | Den Brinker et al. | |
| 2009/0262945 | A1 | 10/2009 | Teo et al. | |
| 2011/0002393 | A1 | 1/2011 | Suzuki et al. | |
| 2011/0235810 | A1 | 9/2011 | Neusinger et al. | |
| 2011/0317843 | A1 | 12/2011 | Lang et al. | |
| 2013/0003980 | A1 | 1/2013 | Toguri et al. | |
| 2013/0195276 | A1* | 8/2013 | Ojala | G10L 19/008 381/2 |

FOREIGN PATENT DOCUMENTS

| | | | |
|---|---|---|---|
| CN | 102074243 | A | 5/2011 |
| JP | 2005522722 | A | 7/2005 |
| JP | 2008511849 | A | 4/2008 |
| JP | 2008522551 | A | 6/2008 |
| JP | 2011013560 | A | 1/2011 |
| KR | 20070030841 | A | 3/2007 |
| KR | 20070061872 | A | 6/2007 |
| WO | WO 2011072729 | A1 | 6/2011 |

OTHER PUBLICATIONS

Baumgarte et al., "Binaural Cue Coding—Part I: Psychoacoustic Fundamentals and Design Principles," IEEE Transactions on Speech and Audio Processing, vol. 11, No. 6, pp. 509-519, Institute of Electrical and Electronics Engineers, New York, New York, (Nov. 2003).

Faller et al., "Binaural Cue Coding—Part II: Schemes and Applications," IEEE Transactions on Speech and Audio Processing, vol. 11, No. 6, pp. 520-531, Institute of Electrical and Electronics Engineers, New York, New York, (Nov. 2003).

Faller et al., "Efficient Representation of Spatial Audio Using Perceptual Parametrization," IEEE Workshop on Applications of Signal Processing to Audio and Acoustics 2001, pp. W2001-1-W2001-4, Institute of Electrical and Electronics Engineers, New York, New York, (Oct. 21-24, 2001).

Marple, Jr., "Estimating Group Delay and Phase Delay via Discrete-Time "Analytic" Cross-Correlation," IEEE Transactions on Signal Processing, vol. 47, No. 9, pp. 2604-2607, Institute of Electrical and Electronics Engineers, New York, New York, (Sep. 1999).

"Series G: Transmission Systems and Media, Digital Systems and Networks; Digital terminal equipments—Coding of voice and audio signals; Wideband embedded extension for G.711 pulse code modulation; Amendment 5: New Appendix IV extending Annex D superwideband for mid-side stereo," Recommendation ITU-T G.711.1 (2008)—Amendment 5; pp. i-3, International Telecommunication Union, Geneva, Switzerland (Mar. 2011).

"Series G: Transmission Systems and Media, Digital Systems and Networks; Digital terminal equipments—Coding of voice and audio signals; 7kHz audio-coding within 64 kbit/s; Amendment 2: New Appendix V extending Annex B superwideband for mid-side stereo," Recommendation ITU-T G.722 (1988)—Amendment 2; pp. i-3, International Telecommunication Union, Geneva, Switzerland (Mar. 2011).

Lang et al., "Multiple Descriptions Speech Codec Based on Sinusoidal Model," Transactions of Beijing Institute of Technology, vol. 27, Issue 1 (Jan. 2007).

* cited by examiner

MULTI-CHANNEL AUDIO ENCODER AND METHOD FOR ENCODING A MULTI-CHANNEL AUDIO SIGNAL

CROSS-REFERENCE TO RELATED APPLICATION

This application is a continuation of International Patent Application No. PCT/EP2012/056321, filed Apr. 5, 2012, which is hereby incorporated herein by reference.

TECHNICAL FIELD

The present disclosure relates to audio coding and in particular to parametric spatial audio coding also known as parametric multi-channel audio coding.

BACKGROUND OF THE INVENTION

Parametric stereo or multi-channel audio coding as described e.g. in C. Faller and F. Baumgarte, "Efficient representation of spatial audio using perceptual parametrization," in Proc. IEEE Workshop on Appl. of Sig. Proc. to Audio and Acoust., October 2001, pp. 199-202, uses spatial cues to synthesize multi-channel audio signals from down-mix—usually mono or stereo—audio signals, the multi-channel audio signals having more channels than the down-mix audio signals. Usually, the down-mix audio signals result from a superposition of a plurality of audio channel signals of a multi-channel audio signal, e.g. of a stereo audio signal. These less channels are waveform coded and side information, i.e. the spatial cues, related to the original signal channel relations is added as encoding parameters to the coded audio channels. The decoder uses this side information to re-generate the original number of audio channels based on the decoded waveform coded audio channels.

A basic parametric stereo coder may use inter-channel level differences (ILD) as a cue needed for generating the stereo signal from the mono down-mix audio signal. More sophisticated coders may also use the inter-channel coherence (ICC), which may represent a degree of similarity between the audio channel signals, i.e. audio channels. Furthermore, when coding binaural stereo signals e.g. for 3D audio or headphone based surround rendering, an inter-channel phase difference (IPD) may also play a role to reproduce phase/delay differences between the channels.

The inter-aural time difference (ITD) is the difference in arrival time of a sound 701 between two ears 703, 705 as can be seen from FIG. 7. It is important for the localization of sounds, as it provides a cue to identify the direction 707 or angle (theta) of incidence of the sound source 701 (relative to the head 709). If a signal arrives to the ears 703, 705 from one side, the signal has a longer path 711 to reach the far ear 703 (contralateral) and a shorter path 713 to reach the near ear 705 (ipsilateral). This path length difference results in a time difference 715 between the sounds arrivals at the ears 703, 705, which is detected and aids the process of identifying the direction 707 of sound source 701.

FIG. 7 gives an example of ITD (denoted as Δt or time difference 715). Differences in time of arrival at the two ears 703, 705 are indicated by a delay of the sound waveform. If a waveform to left ear 703 comes first, the ITD 715 is positive, otherwise, it is negative. If the sound source 701 is directly in front of the listener, the waveform arrives at the same time to both ears 703, 705 and the ITD 715 is thus zero.

ITD cues are important for most of the stereo recording. For instance, binaural audio signal, which can be obtained from real recording using for instance a dummy head or binaural synthesis based on Head Related Transfer Function (HRTF) processing, is used for music recording or audio conferencing. Therefore, it is a very important parameter for low bitrate parametric stereo codec and especially for codec targeting conversational application. Low complexity and stable ITD estimation algorithm is needed for low bitrate parametric stereo codec. Furthermore, the use of ITD parameters, e.g. in addition to other parameters, such as inter-channel level differences (CLDs or ILDs) and inter-channel coherence (ICC), may increase the bitrate overhead. For this specific very low bitrate scenario, only one full band ITD parameter can be transmitted. When only one full band ITD is estimated, the constraint on stability becomes even more difficult to achieve.

In prior art, ITD estimation methods can be classified into three main categories.

ITD estimation may be based on time domain methods. ITD is estimated based on the time domain cross correlation between channels ITD corresponds to the delay where time domain cross correlation $$(f^{*}g)[n] \triangleq \Sigma_{m=-\infty}^{\infty} f^{*}[m]g[n+m]$$

is maximum. This method provides a non-stable estimation of the delay over several frames. This is particularly true when the input signals f and g are wide-band signals with complex sound scene as different sub-band signals may have different ITD values. A non-stable ITD may result in introducing a click (noise) when delay is switched for consecutive frames in the decoder. When this time domain analysis is performed on the full band signal, the bitrate of time domain ITD estimation is low, since only one ITD is estimated, coded and transmitted. However, the complexity is very high, due to the cross-correlation calculation on signals with high sampling frequency.

The second category of ITD estimation method is based on a combination of frequency and time domain approaches. In Marple, S. L., Jr.; "Estimating group delay and phase delay via discrete-time "analytic" cross-correlation," Signal Processing, IEEE Transactions on, vol. 47, no. 9, pp. 2604-2607, September 1999, the frequency and time domain ITD estimation contains the following steps:

1. Fast Fourier Transform (FFT) analysis is applied to the input signals in order to get frequency coefficients.
2. Cross-correlation is calculated in the frequency domain.
3. Frequency domain cross correlation is converted to time domain using an inverse FFT.
4. The ITD is estimated in complex time domain.

This method can also achieve the constraint of low bitrate, since only one full band ITD is estimated, coded and transmitted. However, the complexity is very high, due to the cross-correlation calculation, and inverse FFT which makes this method not applicable when the computational complexity is limited.

Finally, the last category performs the ITD estimation directly in the frequency domain. In Baumgarte, F.; Faller, C.; "Binaural cue coding-Part I: psychoacoustic fundamentals and design principles," Speech and Audio Processing, IEEE Transactions on, vol. 11, no. 6, pp. 509-519, November 2003 and in Faller, C.; Baumgarte, F.; "Binaural cue coding-Part II: Schemes and applications," Speech and Audio Processing, IEEE Transactions on, vol. 11, no. 6, pp. 520-531, November 2003, ITD is estimated in frequency domain, and for each frequency band, an ITD is coded and transmitted. The complexity of this solution is limited, but the required bitrate for this method is high, as one ITD per sub-band has to be transmitted.

Moreover, the reliability and stability of the estimated ITD depend on the frequency bandwidth of the sub-band signal as for large sub-band ITD might not be consistent (different audio sources with different positions might be present in the band limited audio signal).

The very low bitrate parametric multichannel audio coding schemes have not only the constraint on bitrate, but also limitation on available complexity especially for codec targeting implementation in mobile terminal where the battery life must be saved. The state of the art ITD estimation algorithms cannot meet both requirements on low bitrate and low complexity at the same time while maintaining a good quality in terms of stability of the ITD estimation.

SUMMARY OF THE INVENTION

It is an object of the present disclosure to provide a concept for a multi-channel audio encoder which provides both a low bitrate and a low complexity while maintaining a good quality in terms of stability of ITD estimation.

This object is achieved by the features of the independent claims. Further implementation forms are apparent from the dependent claims, the description and the figures.

The present disclosure is based on the finding that applying a smart averaging to inter-channel differences, such as ITD and IPD between band-limited signal portions of two audio channel signals of a multi-channel audio signal reduces both the bitrate and the computational complexity due to the band-limited processing while maintaining a good quality in terms of stability of ITD estimation. A smart averaging discriminates the inter-channel differences by their sign and performs different averages depending on that sign thereby increasing stability of inter-channel difference processing.

In order to describe the present disclosure in detail, the following terms, abbreviations and notations will be used:

BCC: Binaural cues coding, coding of stereo or multi-channel signals using a down-mix and binaural cues (or spatial parameters) to describe inter-channel relationships.

Binaural cues: Inter-channel cues between the left and right ear entrance signals (see also ITD, ILD, and IC).

CLD: Channel level difference, same as ILD.

FFT: Fast implementation of the DFT, denoted Fast Fourier Transform.

HRTF: Head-related transfer function, modeling transduction of sound from a source to left and right ear entrances in free-field.

IC: Inter-aural coherence, i.e. degree of similarity between left and right ear entrance signals. This is sometimes also referred to as IAC or interaural cross-correlation (IACC).

ICC: Inter-channel coherence, inter-channel correlation. Same as IC, but defined more generally between any signal pair (e.g. loudspeaker signal pair, ear entrance signal pair, etc.).

ICPD: Inter-channel phase difference. Average phase difference between a signal pair.

ICLD: Inter-channel level difference. Same as ILD, but defined more generally between any signal pair (e.g. loudspeaker signal pair, ear entrance signal pair, etc.).

ICTD: Inter-channel time difference. Same as ITD, but defined more generally between any signal pair (e.g. loudspeaker signal pair, ear entrance signal pair, etc.).

ILD: Interaural level difference, i.e. level difference between left and right ear entrance signals. This is sometimes also referred to as interaural intensity difference (IID).

IPD: Interaural phase difference, i.e. phase difference between the left and right ear entrance signals.

ITD: Interaural time difference, i.e. time difference between left and right ear entrance signals. This is sometimes also referred to as interaural time delay.

ICD: Inter-channel difference. The general term for a difference between two channels, e.g. a time difference, a phase difference, a level difference or a coherence between the two channels.

Mixing: Given a number of source signals (e.g. separately recorded instruments, multitrack recording), the process of generating stereo or multi-channel audio signals intended for spatial audio playback is denoted mixing.

OCPD: Overall channel phase difference. A common phase modification of two or more audio channels.

Spatial audio: Audio signals which, when played back through an appropriate playback system, evoke an auditory spatial image.

Spatial cues: Cues relevant for spatial perception. This term is used for cues between pairs of channels of a stereo or multi-channel audio signal (see also ICTD, ICLD, and ICC). Also denoted as spatial parameters or binaural cues.

According to a first aspect, the present disclosure relates to a method for determining an encoding parameter for an audio channel signal of a plurality of audio channel signals of a multi-channel audio signal, each audio channel signal having audio channel signal values, the method comprising: determining a frequency transform of the audio channel signal values of the audio channel signal; determining a frequency transform of reference audio signal values of a reference audio signal, wherein the reference audio signal is another audio channel signal of the plurality of audio channel signals; determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band the inter-channel difference is associated to; determining a first average based on positive values of the inter-channel differences and determining a second average based on negative values of the inter-channel differences; and determining the encoding parameter based on the first average and on the second average.

According to a second aspect, the present disclosure relates to a method for determining an encoding parameter for an audio channel signal of a plurality of audio channel signals of a multi-channel audio signal, each audio channel signal having audio channel signal values, the method comprising: determining a frequency transform of the audio channel signal values of the audio channel signal; determining a frequency transform of reference audio signal values of a reference audio signal, wherein the reference audio signal is a down-mix audio signal derived from at least two audio channel signals of the plurality of audio channel signals; determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band the inter-channel difference is associated to; determining a first average based on positive values of the inter-channel differences and determining a second average based on negative values of the inter-channel differences; and determining the encoding parameter based on the first average and on the second average.

The band-limited signal portion can be a frequency domain signal portion. However, the band-limited signal portion can be a time-domain signal portion. In this case, a frequency-domain-time-domain transformer such as inverse Fourier transformer can be employed. In time domain, a time delay average of band-limited signal portions can be performed which corresponds to a phase average in frequency domain. For signal processing, a windowing, e.g. Hamming windowing, can be employed to window the time-domain signal portion.

The band-limited signal portion can span over only one frequency bin or over more than one frequency bins.

In a first possible implementation form of the method according to the first aspect or according to the second aspect, the inter-channel differences are inter-channel phase differences or inter channel time differences.

In a second possible implementation form of the method according to the first aspect as such or according to the second aspect as such or according to the first implementation form of the first aspect or according to the first implementation form of the second aspect, the method further comprises: determining a first standard deviation based on positive values of the inter-channel differences and determining a second standard deviation based on negative values of the inter-channel differences, wherein the determining the encoding parameter is based on the first standard deviation and on the second standard deviation.

In a third possible implementation form of the method according to the first aspect as such or according to the second aspect as such or according to any of the preceding implementation forms of the first aspect or according to any of the preceding implementation forms of the second aspect, a frequency sub-band comprises one or a plurality of frequency bins.

In a fourth possible implementation form of the method according to the first aspect as such or according to the second aspect as such or according to any of the preceding implementation forms of the first aspect or according to any of the preceding implementation forms of the second aspect, the determining inter channel differences for at least each frequency sub-band of a subset of frequency sub-bands comprises: determining a cross-spectrum as a cross correlation from the frequency transform of the audio channel signal values and the frequency transform of the reference audio signal values; determining inter channel phase differences for each frequency sub band based on the cross spectrum.

In a fifth possible implementation form of the method according to the fourth implementation form of the first aspect or according to the fourth implementation form of the second aspect, the inter channel phase difference of a frequency bin or of a frequency sub-band is determined as an angle of the cross spectrum.

In a sixth possible implementation form of the method according to the fourth or the fifth implementation form of the first aspect or according to the fourth or the fifth implementation form of the second aspect, the method further comprises: determining inter-aural time differences based on the inter channel phase differences; wherein the determining the first average is based on positive values of the inter-aural time differences and the determining the second average is based on negative values of the inter-aural time differences.

In a seventh possible implementation form of the method according to the fourth or the fifth implementation form of the first aspect or according to the fourth or the fifth implementation form of the second aspect, the inter-aural time difference of a frequency sub-band is determined as a function of the inter channel phase difference, the function depending on a number of frequency bins and on the frequency bin or frequency sub-band index.

In an eighth possible implementation form of the method according to the sixth or the seventh implementation form of the first aspect or according to the sixth or the seventh implementation form of the second aspect, the determining the encoding parameter comprises: counting a first number of positive inter-aural time differences and a second number of negative inter-aural time differences over the number of frequency sub-bands comprised in the sub-set of frequency sub-bands.

In a ninth possible implementation form of the method according to the eighth implementation form of the first aspect or according to the eighth implementation form of the second aspect, the encoding parameter is determined based on a comparison between the first number of positive inter-aural time differences and the second number of negative inter-aural time differences.

In a tenth possible implementation form of the method according to the ninth implementation form of the first aspect or according to the ninth implementation form of the second aspect, the encoding parameter is determined based on a comparison between the first standard deviation and the second standard deviation.

In an eleventh possible implementation form of the method according to the ninth or the tenth implementation form of the first aspect or according to the ninth or the tenth implementation form of the second aspect, the encoding parameter is determined based on a comparison between the first number of positive inter-aural time differences and the second number of negative inter-aural time differences multiplied by a first factor.

In a twelfth possible implementation form of the method according to the eleventh implementation form of the first aspect or according to the eleventh implementation form of the second aspect, the encoding parameter is determined based on a comparison between the first standard deviation and the second standard deviation multiplied by a second factor.

In a thirteenth possible implementation form of the method according to the sixth or the seventh implementation form of the first aspect or according to the sixth or the seventh implementation form of the second aspect, the determining the encoding parameter comprises: counting a first number of positive inter channel differences and a second number of negative inter channel differences over the number of frequency sub-bands comprised in the sub-set of frequency sub-bands.

In a fourteenth possible implementation form of the method according to the first aspect as such or according to the second aspect as such or according to any of the preceding implementation forms of the first aspect or according to any of the preceding implementation forms of the second aspect, the method is applied in one or in combinations of the following encoders: an ITU-T G.722 encoder, an ITU-T G.722 Annex B encoder, an ITU-T G.711.1 encoder, an ITU-T G.711.1 Annex D encoder, and a 3GPP Enhanced Voice Services Encoder.

Compared to an estimation of the ITD providing an average estimation of the sub-band ITD, the methods according to the first or second aspect select the most relevant ITD within the sub-band. Thus, a low bitrate and a low complexity ITD estimation is achieved while maintaining a good quality in terms of stability of ITD estimation.

According to a third aspect, the disclosure relates to a multi-channel audio encoder for determining an encoding parameter for an audio channel signal of a plurality of audio channel signals of a multi-channel audio signal, each audio channel signal having audio channel signal values, the parametric spatial audio encoder comprising: a frequency transformer such as a Fourier transformer, for determining a frequency transform of the audio channel signal values of the audio channel signal and for determining a frequency transform of reference audio signal values of a reference audio signal, wherein the reference audio signal is another audio channel signal of the plurality of audio channel signals; an inter channel difference determiner for determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band the inter-channel difference is associated to; an average determiner for determining a first average based on positive values of the inter-channel differences and for determining a second average based on negative values of the inter-channel differences; and an encoding parameter determiner for determining the encoding parameter based on the first average and on the second average.

According to a fourth aspect, the disclosure relates to a multi-channel audio encoder for determining an encoding parameter for an audio channel signal of a plurality of audio channel signals of a multi-channel audio signal, each audio channel signal having audio channel signal values, the parametric spatial audio encoder comprising: a frequency transformer such as a Fourier transformer, for determining a frequency transform of the audio channel signal values of the audio channel signal and for determining a frequency transform of reference audio signal values of a reference audio signal, wherein the reference audio signal is a down-mix audio signal derived from at least two audio channel signals of the plurality of audio channel signals; an inter channel difference determiner for determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band, the inter-channel difference is associated to; an average determiner for determining a first average based on positive values of the inter-channel differences and for determining a second average based on negative values of the inter-channel differences; and an encoding parameter determiner for determining the encoding parameter based on the first average and on the second average.

According to a fifth aspect, the disclosure relates to a computer program with a program code for performing the method according to the first aspect as such or according to the second aspect as such or according to any of the preceding claims of the first aspect or according to any of the preceding claims of the second aspect when run on a computer.

The computer program has reduced complexity and can thus be efficiently implemented in mobile terminal where the battery life must be saved.

According to a sixth aspect, the present disclosure relates to a parametric spatial audio encoder being configured to implement the method according to the first aspect as such or according to the second aspect as such or according to any of the preceding implementation forms of the first aspect or according to any of the preceding implementation forms of the second aspect.

In a first possible implementation form of the parametric spatial audio encoder according to the sixth aspect, the parametric spatial audio encoder comprises a processor implementing the method according to the first aspect as such or according to the second aspect as such or according to any of the preceding implementation forms of the first aspect or according to any of the preceding implementation forms of the second aspect.

In a second possible implementation form of the parametric spatial audio encoder according to the sixth aspect as such or according to the first implementation form of the sixth aspect, the parametric spatial audio encoder comprises a frequency transformer such as Fourier transformer, for determining a frequency transform of the audio channel signal values of the audio channel signal and for determining a frequency transform of reference audio signal values of a reference audio signal, wherein the reference audio signal is another audio channel signal of the plurality of audio channel signals or a down-mix audio signal derived from at least two audio channel signals of the plurality of audio channel signals; an inter channel difference determiner for determining inter channel differences for at least each frequency sub-band of a subset of frequency sub-bands, each inter channel difference indicating a phase difference or time difference between the band-limited signal portion of the audio channel signal and the band-limited signal portion of the reference audio signal in the respective sub-band, the inter-channel difference is associated to; an average determiner for determining a first average based on positive values of the inter-channel differences and determining a second average based on negative values of the inter-channel differences; and an encoding parameter determiner for determining the encoding parameter based on the first average and the second average.

According to a seventh aspect, the present disclosure relates to a machine readable medium such as a storage, in particular a compact disc, with a computer program comprising a program code for performing the method according to the first aspect as such or according to the second aspect as such or according to any of the preceding claims of the first aspect or according to any of the preceding claims of the second aspect when run on a computer.

The methods described herein may be implemented as software in a Digital Signal Processor (DSP), in a micro-controller or in any other side-processor or as hardware circuit within an application specific integrated circuit (ASIC).

The present disclosure can be implemented in digital electronic circuitry, or in computer hardware, firmware, software, or in combinations thereof.

BRIEF DESCRIPTION OF THE DRAWINGS

Further embodiments of the invention will be described with respect to the following figures, in which.

DETAILED DESCRIPTION OF EMBODIMENTS OF THE INVENTION

Figure 1:
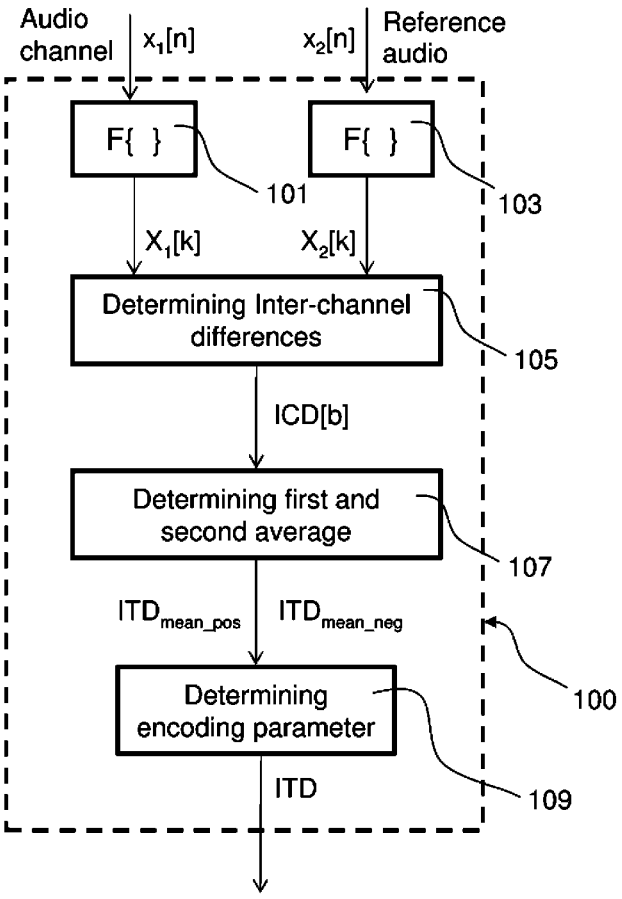
FIG. 1 shows a schematic diagram of a method for generating an encoding parameter for an audio channel signal according to an implementation form.

FIG. 1 shows a schematic diagram of a method for generating an encoding parameter for an audio channel signal according to an implementation form.

The method 100 is for determining the encoding parameter ITD for an audio channel signal $x_1$ of a plurality of audio channel signals $x_1$, $x_2$ of a multi-channel audio signal. Each audio channel signal $x_1$, $x_2$ has audio channel signal values $x_1[n]$, $x_2[n]$. FIG. 1 depicts the stereo case where the plurality of audio channel signals comprises a left audio channel $x_1$ and a right audio channel $x_2$. The method 100 comprises:

determining 101 a frequency transform $X_1[k]$ of the audio channel signal values $x_1[n]$ of the audio channel signal $x_1$;

determining 103 a frequency transform $X_2[k]$ of reference audio signal values $x_2[n]$ of a reference audio signal $x_2$, wherein the reference audio signal is another audio channel signal $x_2$ of the plurality of audio channel signals or a downmix audio signal derived from at least two audio channel signals $x_1$, $x_2$ of the plurality of audio channel signals;

determining 105 inter channel differences ICD[b] for at least each frequency sub-band b of a subset of frequency sub-bands, each inter channel difference indicating a phase difference IPD[b] or time difference ITD[b] between a band-limited signal portion of the audio channel signal and a band-limited signal portion of the reference audio signal in the respective frequency sub-band b the inter-channel difference is associated to;

determining 107 a first average $ITD_{mean_pos}$ based on positive values of the inter-channel differences ICD[b] and determining a second average $ITD_{mean_neg}$ based on negative values of the inter-channel differences ICD[b]; and determining 109 the encoding parameter ITD based on the first average and on the second average.

In an implementation form, the band-limited signal portion of the audio channel signal and the band-limited signal portion of the reference audio signal refer to the respective sub-band and its frequency bins in frequency domain.

In an implementation form, the band-limited signal portion of the audio channel signal and the band-limited signal portion of the reference audio signal refer to the respective time-transformed signal of the sub-band in time domain.

The band-limited signal portion can be a frequency domain signal portion. However, the band-limited signal portion can be a time-domain signal portion. In this case, a frequency-domain-time-domain transformer such as inverse Fourier transformer can be employed. In time domain, a time delay average of band-limited signal portions can be performed which corresponds to a phase average in frequency domain. For signal processing, a windowing, e.g. Hamming windowing, can be employed to window the time-domain signal portion.

The band-limited signal portion can span over only one frequency bin or over more than one frequency bins.

In an implementation form, the method 100 is processed as follows:

In a first step corresponding to 101 and 103 in FIG. 1, a time frequency transform is applied on the time-domain input channel, e.g. the first input channel $x_1$ and the time-domain reference channel, e.g. the second input channel $x_2$. In case of stereo these are the left and right channels. In a preferred embodiment, the time frequency transform is a Fast Fourier Transform (FFT) or a Short Term Fourier Transform (STFT). In an alternative embodiment, the time frequency transform is a cosine modulated filter bank or a complex filter bank.

In a second step corresponding to 105 in FIG. 1, a cross-spectrum is computed for each frequency bin [b] of the FFT as:

$$c[b]=X_1[b]X_2^*[b],$$

where c[b] is the cross-spectrum of frequency bin [b] and $X_1[b]$ and $X_2[b]$ are the FFT coefficients of the two channels * denotes complex conjugation. For this case, a sub-band b corresponds directly to one frequency bin [k], frequency bin [b] and [k] represent exactly the same frequency bin.

Alternatively, the cross-spectrum is computed per sub-band [k] as:

$$c[b]=\Sigma_{k=k_b}^{k_{b+1}-1}X_1[k]X_2^*[k],$$

where c[b] is the cross-spectrum of sub-band [b] and $X_1[k]$ and $X_2[k]$ are the FFT coefficients of the two channels, for instance left and right channel in case of stereo. * denotes complex conjugation. $k_b$ is the start bin of sub-band [b]. The cross-spectrum can be a smoothed version, which is calculated by following equation $$c_{sm}[b,i]=\mathrm{SMW}_1*c_{sm}[b,i-1]+(1-\mathrm{SMW}_1)*c[b]$$

where SMW1 is the smooth factor. i is the frame index.

The inter channel phase differences (IPDs) are calculated per sub-band based on the cross-spectrum as:

$$\mathrm{IPD}[b]=\angle c[b]$$

where the operation ∠ is the argument operator to compute the angle of c[b]. It should be noted that in case of smoothing of the cross-spectrum, $c_{sm}[b,i]$ is used for IPD calculation as $$\mathrm{IPD}[b]=\angle c_{sm}[b,i]$$

In a third step corresponding to 105 in FIG. 1, ITDs of each frequency bin (or sub-band) are calculated based on IPDs.

$$ITD[b]=\frac{IPD[b]N}{\pi b}$$

where N is the number of FFT bin.

In a fourth step, corresponding to 107 in FIG. 1 counting of positive and negative values of ITD is performed. The mean and standard deviation of positive and negative ITD are based on the sign of ITD as follows:

$$ITD_{mean_pos}=\frac{\sum_{i=0}^{i=M}ITD(i)}{Nb_{pos}}\ \text{where}\ ITD(i)\geq 0$$

-continued $$ITD_{mean_neg} = \frac{\sum_{i=0}^{i=M} ITD(i)}{Nb_{neg}} \text{ where } ITD(i) < 0$$

$$ITD_{std_pos} = \sqrt{\frac{\sum_{i=0}^{i=M} (ITD(i) - ITD_{mean_pos})^2}{Nb_{pos}}} \text{ where } ITD(i) \geq 0$$

$$ITD_{std_neg} = \sqrt{\frac{\sum_{i=0}^{i=M} (ITD(i) - ITD_{mean_neg})^2}{Nb_{neg}}} \text{ where } ITD(i) < 0$$

where $Nb_{pos}$ and $Nb_{neg}$ are the number of positive and negative ITD respectively. M is the total number of ITDs which are extracted. It should be noted that alternatively, if ITD is equal to 0, it can be either counted in negative ITD or not counted in none of the average.

Figure 3:
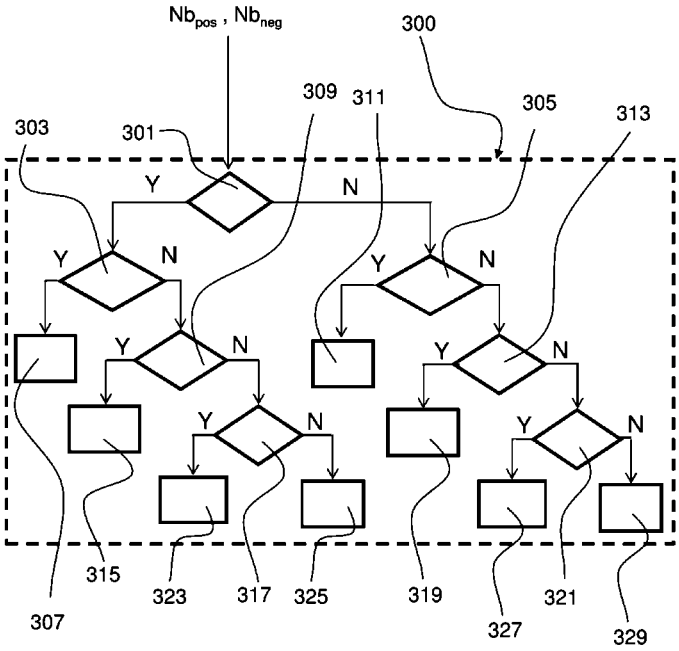
FIG. 3 shows a schematic diagram of an ITD selection algorithm according to an implementation form.

In a fifth step corresponding to 109 in FIG. 1, ITD is selected from positive and negative ITD based on the mean and standard deviation. The selection algorithm is shown in FIG. 3.

Figure 2:
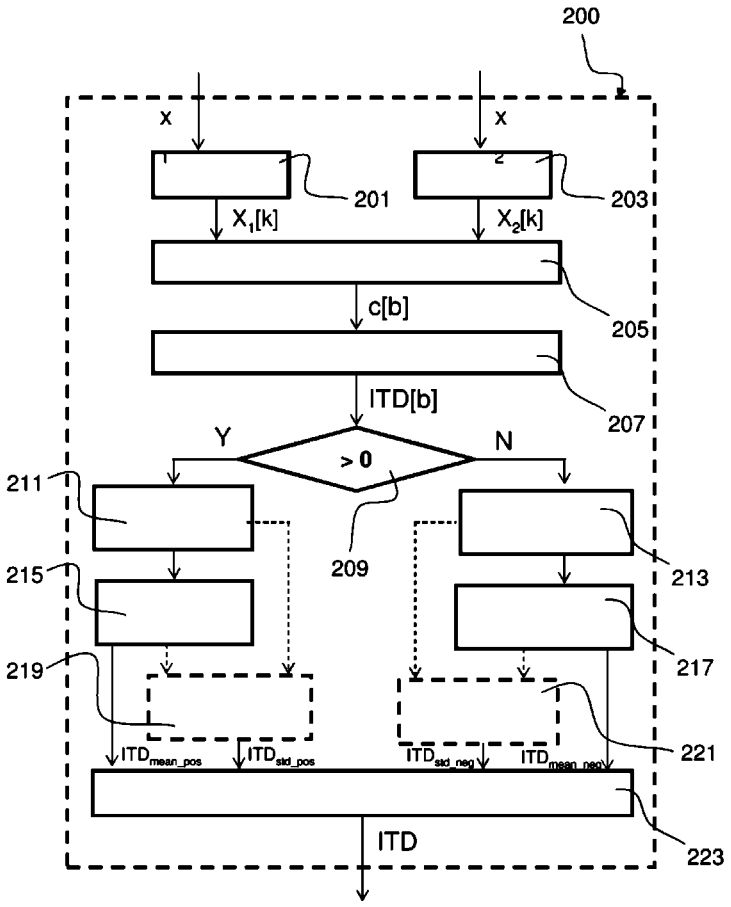
FIG. 2 shows a schematic diagram of an ITD estimation algorithm according to an implementation form.

FIG. 2 shows a schematic diagram of an ITD estimation algorithm 200 according to an implementation form.

In a first step 201 corresponding to 101 in FIG. 1, a time frequency transform is applied on the time-domain input channel, e.g. the first input channel $x_1$. In a preferred embodiment, the time frequency transform is a Fast Fourier Transform (FFT) or a Short Term Fourier Transform (STFT). In an alternative embodiment, the time frequency transform is a cosine modulated filter bank or a complex filter bank.

In a second step 203 corresponding to 103 in FIG. 1, a time frequency transform is applied on the time-domain reference channel, e.g. the second input channel $x_2$. In a preferred embodiment, the time frequency transform is a Fast Fourier Transform (FFT) or a Short Term Fourier Transform (STFT). In an alternative embodiment, the time frequency transform is a cosine modulated filter bank or a complex filter bank.

In a subsequent third step 205 corresponding to 105 in FIG. 1, a cross correlation of each frequency bin is calculated which is performed on a limited number of frequency bins or frequency sub-bands. A cross-spectrum is computed from the cross correlation for each frequency bin [b] of the FFT as:

$$c[b]=X_1[b]X_2^*[b],$$

where c[b] is the cross-spectrum of frequency bin [b] and $X_1[b]$ and $X_2[b]$ are the FFT coefficients of the two channels * denotes complex conjugation. For this case, a sub-band b corresponds directly to one frequency bin [k], frequency bin [b] and [k] represent exactly the same frequency bin.

Alternatively, the cross-spectrum is computed per sub-band [k] as:

$$c[b]=\Sigma_{k=k_b}^{k_{b+1}-1} X_1[k]X_2^*[k],$$

where c[b] is the cross-spectrum of sub-band [b] and $X_1[k]$ and $X_2[k]$ are the FFT coefficients of the two channels, for instance left and right channel in case of stereo. * denotes complex conjugation. $k_b$ is the start bin of sub-band [b].

The cross-spectrum can be a smoothed version, which is calculated by following equation $$c_{sm}[b,i]=SMW_1 * c_{sm}[b,i-1]+(1-SMW_1) * c[b]$$

where SMW1 is the smooth factor. i is the frame index.

Inter channel phase differences (IPDs) are calculated per sub-band based on the cross-spectrum as:

$$IPD[b]=\angle c[b]$$

where the operation ∠ is the argument operator to compute the angle of c[b]. It should be noted that in case of smoothing of the cross-spectrum, $c_{sm}[b,i]$ is used for IPD calculation as $$IPD[b]=\angle c_{sm}[b,i]$$

In a subsequent fourth step 207 corresponding to 105 in FIG. 1, ITDs of each frequency bin (or sub-band) are calculated based on IPDs.

$$ITD[b] = \frac{IPD[b]N}{\pi b}$$

where N is the number of FFT bin.

In a subsequent fifth step 209, corresponding to 107 in FIG. 1 the calculated ITD of step 207 is checked on being greater than zero. If yes, step 211 is processed, if no, step 213 is processed.

In step 211 after step 209 a sum over a number of M frequency bin (or sub-band) values of ITD is calculated, e.g. according to "Nb_itd_pos++,,Itd_sum_pos+=ITD".

In step 213 after step 209 a sum over a number of M frequency bin (or sub-band) values of ITD is calculated, e.g. according to "Nb_itd_neg++,,Itd_sum_neg+=ITD".

In step 215 after step 211, a mean of positive ITDs is calculated according to the equation $$ITD_{mean_pos} = \frac{\sum_{i=0}^{i=M} ITD(i)}{Nb_{pos}} \text{ where } ITD(i) \geq 0$$

where $Nb_{pos}$ is the number of positive ITD values and M is the total number of ITDs which are extracted.

In the optional step 219 after step 215, a standard deviation of positive ITDs is calculated according to the equation $$ITD_{std_pos} = \sqrt{\frac{\sum_{i=0}^{i=M} (ITD(i) - ITD_{mean_pos})^2}{Nb_{pos}}} \text{ where } ITD(i) \geq 0$$

In step 217 after step 213, a mean of negative ITDs is calculated according to the equation $$ITD_{mean_neg} = \frac{\sum_{i=0}^{i=M} ITD(i)}{Nb_{neg}} \text{ where } ITD(i) < 0$$

where $Nb_{neg}$ is the number of negative ITD values and M is the total number of ITDs which are extracted.

In the optional step 221 after step 217, a standard deviation of negative ITDs is calculated according to the equation $$ITD_{std_neg} = \sqrt{\frac{\sum_{i=0}^{i=M} (ITD(i) - ITD_{mean_neg})^2}{Nb_{neg}}} \text{ where } ITD(i) < 0$$

In a last step 223 corresponding to 109 in FIG. 1, ITD is selected from positive and negative ITD based on the mean and optionally on the standard deviation. The selection algorithm is shown in FIG. 3.

This method 200 can be applied to full band ITD estimation, in that case, the sub-bands b cover the full range of frequency (up to B). The sub-bands b can be chosen to follow perceptual decomposition of the spectrum as for instance the critical bands or Equivalent Rectangular Bandwidth (ERB). In an alternative embodiment, a full band ITD can be estimated based on the most relevant sub-bands b. By most relevant, it should be understood, the sub-bands which are perceptually relevant for the ITD perception (for instance between 200 Hz and 1500 Hz).

The benefit of the ITD estimation according to the first or second aspect of the present disclosure is that, if there are two speakers on the left and right side of the listener respectively, and they are talking at the same time, the simple average of all the ITD will give a value near to zero, which is not correct. Because the zero ITD means the speaker is just in front of the listener. Even if the average of all ITD is not zero, it will narrow the stereo image. Also in this example, the method 200 will select one ITD from the means of positive and negative ITD, based on the stability of the extracted ITD, which gives a better estimation, in terms of source direction.

The standard deviation is a way to measure the stability of the parameters. If the standard deviation is small, the estimated parameters are more stable and reliable. The purpose of using standard deviation of positive and negative ITD is to see which one is more reliable. And select the reliable one as the final output ITD. Other similar parameter such as extremism difference can also be used to check the stability of the ITD. Therefore, standard deviation is optional here.

In a further implementation form, the negative and positive counting is performed directly on the IPDs, as a direct relation between IPD and ITD exists. The decision process is then performed directly on the negative and positive IPD means.

The method 100, 200 as described in FIGS. 1 and 2 can be applied in the encoder of the stereo extension of ITU-T G.722, G.722 Annex B, G.711.1 and/or G.711.1 Annex D. Moreover, the described method can also be applied for speech and audio encoder for mobile application as defined in 3GGP EVS (Enhanced Voice Services) codec.

FIG. 3 shows a schematic diagram of an ITD selection algorithm according to an implementation form.

In a first step 301, the number $Nb_{pos}$ of positive ITD values is checked against the number $Nb_{neg}$ of negative ITD values. If $Nb_{pos}$ is greater than $Nb_{neg}$, step 303 is performed; If $Nb_{pos}$ is not greater than $Nb_{neg}$, step 305 is performed.

In step 303, the standard deviation $ITD_{std_pos}$ of positive ITDs is checked against the standard deviation $ITD_{std_neg}$ of negative ITDs and the number $Nb_{pos}$ of positive ITD values is checked against the number $Nb_{neg}$ of negative ITD values multiplied by a first factor A, e.g. according to: $(ITD_{std_pos}<ITD_{std_neg})\|(Nb_{pos}>=A*Nb_{neg})$. If $ITD_{std_pos}<ITD_{std_neg}$ or $Nb_{pos}>A*Nb_{neg}$, ITD is selected as the mean of positive ITD in step 307. Otherwise, the relation between positive and negative ITD will be further checked in step 309.

In step 309, the standard deviation $ITD_{std_neg}$ of negative ITDs is checked against the standard deviation $ITD_{std_pos}$ of positive ITDs multiplied by a second factor B, e.g. according to: $(ITD_{std_neg}<B*ITD_{std_pos})$. If $ITD_{std_neg}<B*ITD_{std_pos}$, the opposite value of negative ITD mean will be selected as output ITD in step 315. Otherwise, ITD from previous frame (Pre_itd) is checked in step 317.

In step 317, ITD from previous frame is checked on being greater than zero, e.g. according to "Pre_itd>0". If Pre_itd>0, output ITD is selected as the mean of positive ITD in step 323, otherwise, the output ITD is the opposite value of negative ITD mean in step 325.

In step 305, the standard deviation $ITD_{std_neg}$ of negative ITDs is checked against the standard deviation $ITD_{std_pos}$ of positive ITDs and the number $Nb_{neg}$ of negative ITD values is checked against the number $Nb_{pos}$ of positive ITD values multiplied by a first factor A, e.g. according to: $(ITD_{std_neg}<ITD_{std_pos})\|(Nb_{neg}>=A*Nb_{pos})$. If $ITD_{std_neg}<ITD_{std_pos}$ or $Nb_{neg}>A*Nb_{pos}$, ITD is selected as the mean of negative ITD in step 311. Otherwise, the relation between negative and positive ITD is further checked in step 313.

In step 313, the standard deviation $ITD_{std_pos}$ of positive ITDs is checked against the standard deviation $ITD_{std_neg}$ of negative ITDs multiplied by a second factor B, e.g. according to: $(ITD_{std_pos}<B*ITD_{std_neg})$. If $ITD_{std_pos}<B*ITD_{std_neg}$, the opposite value of positive ITD mean is selected as output ITD in step 319. Otherwise, ITD from previous frame (Pre_itd) is checked in step 321.

In step 321, ITD from previous frame is checked on being greater than zero, e.g. according to "Pre_itd>0". If Pre_itd>0, output ITD is selected as the mean of negative ITD in step 327, otherwise, the output ITD is the opposite value of positive ITD mean in step 329.

Figure 4:
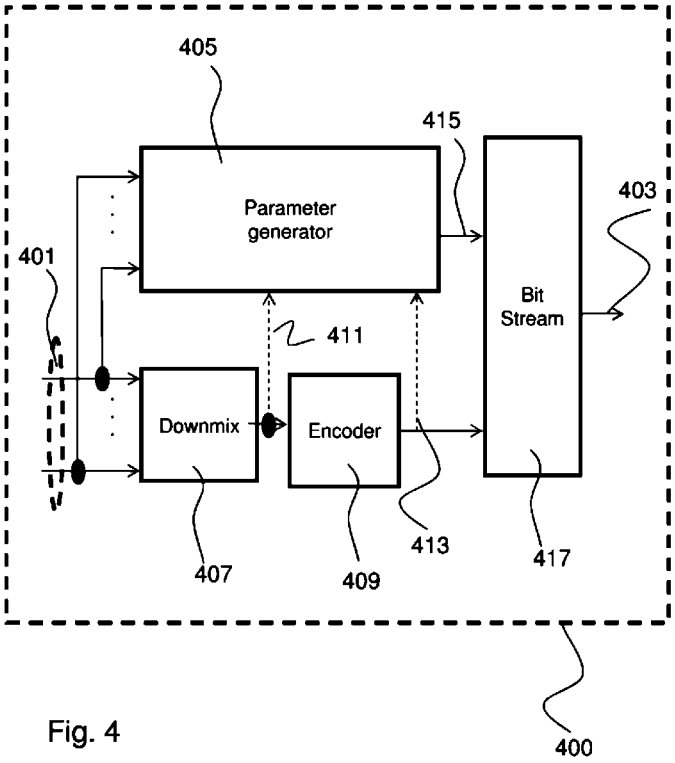
FIG. 4 shows a block diagram of a parametric audio encoder according to an implementation form.

FIG. 4 shows a block diagram of a parametric audio encoder 400 according to an implementation form. The parametric audio encoder 400 receives a multi-channel audio signal 401 as input signal and provides a bit stream as output signal 403. The parametric audio encoder 400 comprises a parameter generator 405 coupled to the multi-channel audio signal 401 for generating an encoding parameter 415, a down-mix signal generator 407 coupled to the multi-channel audio signal 401 for generating a down-mix signal 411 or sum signal, an audio encoder 409 coupled to the down-mix signal generator 407 for encoding the down-mix signal 411 to provide an encoded audio signal 413 and a combiner 417, e.g. a bit stream former coupled to the parameter generator 405 and the audio encoder 409 to form a bit stream 403 from the encoding parameter 415 and the encoded signal 413.

The parametric audio encoder 400 implements an audio coding scheme for stereo and multi-channel audio signals, which only transmits one single audio channel, e.g. the downmix representation of input audio channel plus additional parameters describing "perceptually relevant differences" between the audio channels $x_1, x_2, \ldots, x_M$. The coding scheme is according to binaural cue coding (BCC) because binaural cues play an important role in it. As indicated in the figure, the input audio channels $x_1, x_2, \ldots, x_M$ are down-mixed to one single audio channel 411, also denoted as the sum signal. As "perceptually relevant differences" between the audio channels $x_1, x_2, \ldots, x_M$, the encoding parameter 415, e.g., an inter-channel time difference (ICTD), an inter-channel level difference (ICLD), and/or an inter-channel coherence (ICC), is estimated as a function of frequency and time and transmitted as side information to the decoder 500 described in FIG. 5.

The parameter generator 405 implementing BCC processes the multi-channel audio signal 401 with a certain time and frequency resolution. The frequency resolution used is largely motivated by the frequency resolution of the auditory system. Psychoacoustics suggests that spatial perception is most likely based on a critical band representation of the acoustic input signal. This frequency resolution is considered by using an invertible filter-bank with sub-bands with bandwidths equal or proportional to the critical bandwidth of the auditory system. It is important that the transmitted sum signal 411 contains all signal components of the multi-channel audio signal 401. The goal is that each signal component is fully maintained. Simple summation of the audio input channels $x_1, x_2, \ldots, x_M$ of the multi-channel audio signal 401 often results in amplification or attenuation of signal components. In other words, the power of signal components in the "simple" sum is often larger or smaller than the sum of the power of the corresponding signal component of each channel $x_1, x_2, \ldots, x_M$. Therefore, a down-mixing technique is used by applying the down-mixing device 407 which equalizes the sum signal 411 such that the power of signal components in the sum signal 411 is approximately the same as the corresponding power in all input audio channels $x_1, x_2, \ldots, x_M$ of the multi-channel audio signal 401. The input audio channels $x_1, x_2, \ldots, x_M$ are decomposed into a number of sub-bands. One such sub-band is denoted $X_1[b]$ (note that for notational simplicity no sub-band index is used). Similar processing is independently applied to all sub-bands, usually the sub-band signals are down-sampled. The signals of each sub-band of each input channel are added and then multiplied with a power normalization factor.

Given the sum signal 411, the parameter generator 405 synthesizes a stereo or multi-channel audio signal 415 such that ICTD, ICLD, and/or ICC approximate the corresponding cues of the original multi-channel audio signal 401.

When considering binaural room impulse responses (BRIRs) of one source, there is a relationship between width of the auditory event and listener envelopment and IC estimated for the early and late parts of the binaural room impulse responses. However, the relationship between IC or ICC and these properties for general signals and not just the BRIRs is not straightforward. Stereo and multi-channel audio signals usually contain a complex mix of concurrently active source signals superimposed by reflected signal components resulting from recording in enclosed spaces or added by the recording engineer for artificially creating a spatial impression. Different sound source signals and their reflections occupy different regions in the time-frequency plane. This is reflected by ICTD, ICLD, and ICC which vary as a function of time and frequency. In this case, the relation between instantaneous ICTD, ICLD, and ICC and auditory event directions and spatial impression is not obvious. The strategy of the parameter generator 405 is to blindly synthesize these cues such that they approximate the corresponding cues of the original audio signal.

In an implementation form, the parametric audio encoder 400 uses filter-banks with sub-bands of bandwidths equal to two times the equivalent rectangular bandwidth. Informal listening revealed that the audio quality of BCC did not notably improve when choosing higher frequency resolution. A lower frequency resolution is favorable since it results in less ICTD, ICLD, and ICC values that need to be transmitted to the decoder and thus in a lower bitrate. Regarding time-resolution, ICTD, ICLD, and ICC are considered at regular time intervals. In an implementation form ICTD, ICLD, and ICC are considered about every 4-16 ms. Note that unless the cues are considered at very short time intervals, the precedence effect is not directly considered.

The often achieved perceptually small difference between reference signal and synthesized signal implies that cues related to a wide range of auditory spatial image attributes are implicitly considered by synthesizing ICTD, ICLD, and ICC at regular time intervals. The bitrate required for transmission of these spatial cues is just a few kb/s and thus the parametric audio encoder 400 is able to transmit stereo and multi-channel audio signals at bitrates close to what is required for a single audio channel FIGS. 1 and 2 illustrate a method in which ICTD is estimated as the encoding parameter 415.

The parametric audio encoder 400 comprises the down-mix signal generator 407 for superimposing at least two of the audio channel signals of the multi-channel audio signal 401 to obtain the down-mix signal 411, the audio encoder 409, in particular a mono encoder, for encoding the down-mix signal 411 to obtain the encoded audio signal 413, and the combiner 417 for combining the encoded audio signal 413 with a corresponding encoding parameter 415.

The parametric audio encoder 400 generates the encoding parameter 415 for one audio channel signal of the plurality of audio channel signals denoted as $x_1, x_2, \ldots, x_M$ of the multi-channel audio signal 401. Each of the audio channel signals $x_1, x_2, \ldots, x_M$ may be a digital signal comprising digital audio channel signal values denoted as $x_1[n], x_2[n], \ldots, x_M[n]$.

An exemplary audio channel signal for which the parametric audio encoder 400 generates the encoding parameter 415 is the first audio channel signal $x_1$ with signal values $x_1[n]$. The parameter generator 405 determines the encoding parameter ITD from the audio channel signal values $x_1[n]$ of the first audio signal $x_1$ and from reference audio signal values $x_2[n]$ of a reference audio signal $x_2$.

An audio channel signal which is used as a reference audio signal is the second audio channel signal $x_2$, for example. Similarly any other one of the audio channel signals $x_1, x_2, \ldots, x_M$ may serve as reference audio signal. According to a first aspect, the reference audio signal is another audio channel signal of the audio channel signals which is not equal to the audio channel signal $x_1$ for which the encoding parameter 415 is generated.

According to a second aspect, the reference audio signal is a down-mix audio signal derived from at least two audio channel signals of the plurality of multi-channel audio signals 401, e.g. derived from the first audio channel signal $x_1$ and the second audio channel signal $x_2$. In an implementation form, the reference audio signal is the down-mix signal 411, also called sum signal generated by the down-mixing device 407. In an implementation form, the reference audio signal is the encoded signal 413 provided by the encoder 409.

An exemplary reference audio signal used by the parameter generator 405 is the second audio channel signal $x_2$ with signal values $x_2[n]$.

The parameter generator 405 determines a frequency transform of the audio channel signal values $x_1[n]$ of the audio channel signal $x_1$ and a frequency transform of the reference audio signal values $x_2[n]$ of the reference audio signal $x_1$. The reference audio signal is another audio channel signal $x_2$ of the plurality of audio channel signals or a downmix audio signal derived from at least two audio channel signals $x_1$, $x_2$ of the plurality of audio channel signals.

The parameter generator 405 determines inter channel difference for at least each frequency sub-band of a subset of frequency sub-bands. Each inter channel difference indicates a phase difference IPD[b] or time difference ITD[b] between a band-limited signal portion of the audio channel signal and a band-limited signal portion of the reference audio signal in the respective frequency sub-band the inter-channel difference is associated to.

The parameter generator 405 determines a first average $ITD_{mean_pos}$ based on positive values of the inter-channel differences IPD[b], ITD[b] and a second average $ITD_{mean_neg}$ based on negative values of the inter-channel differences IPD[b], ITD[b]. The parameter generator 405 determines the encoding parameter ITD based on the first average and on the second average.

An inter-channel phase difference (ICPD) is an average phase difference between a signal pair. An inter-channel level difference (ICLD) is the same as an interaural level difference (ILD), i.e. a level difference between left and right ear entrance signals, but defined more generally between any signal pair, e.g. a loudspeaker signal pair, an ear entrance signal pair, etc. An inter-channel coherence or an inter-channel correlation is the same as an inter-aural coherence (IC), i.e. the degree of similarity between left and right ear entrance signals, but defined more generally between any signal pair, e.g. loudspeaker signal pair, ear entrance signal pair, etc. An inter-channel time difference (ICTD) is the same as an inter-aural time difference (ITD), sometimes also referred to as interaural time delay, i.e. a time difference between left and right ear entrance signals, but defined more generally between any signal pair, e.g. loudspeaker signal pair, ear entrance signal pair, etc. The sub-band inter-channel level differences, sub-band inter-channel phase differences, sub-band inter-channel coherences and sub-band inter-channel intensity differences are related to the parameters specified above with respect to the sub-band bandwidth.

In a first step, the parameter generator 405 applies a time frequency transform on the time-domain input channel, e.g. the first input channel $x_1$ and the time-domain reference channel, e.g. the second input channel $x_2$. In case of stereo these are the left and right channels. In a preferred embodiment, the time frequency transform is a Fast Fourier Transform (FFT) or a Short Term Fourier Transform (STFT). In an alternative embodiment, the time frequency transform is a cosine modulated filter bank or a complex filter bank.

In a second step, the parameter generator 405 computes a cross-spectrum for each frequency bin [b] of the FFT as:

$$c[b]=X_1[b]X_2^*[b],$$

where c[b] is the cross-spectrum of frequency bin [b] and $X_1[b]$ and $X_2[b]$ are the FFT coefficients of the two channels * denotes complex conjugation. For this case, a sub-band b corresponds directly to one frequency bin [k], frequency bin [b] and [k] represent exactly the same frequency bin.

Alternatively, the parameter generator 405 computes the cross-spectrum per sub-band [k] as:

$$c[b]=\Sigma_{k=k_b}^{k_{b+1}-1}X_1[k]X_2^*[k],$$

where c[b] is the cross-spectrum of sub-band [b] and $X_1[k]$ and $X_2[k]$ are the FFT coefficients of the two channels, for instance left and right channel in case of stereo. * denotes complex conjugation. $k_b$ is the start bin of sub-band [b].

The cross-spectrum can be a smoothed version, which is calculated by following equation $$c_{sm}[b,i]=\mathrm{SMW}_1*c_{sm}[b,i-1]+(1-\mathrm{SMW}_1)*c[b]$$

where SMW1 is the smooth factor. i is the frame index.

The inter channel phase differences (IPDs) are calculated per sub-band based on the cross-spectrum as:

$$\mathrm{IPD}[b]=\angle c[b]$$

where the operation ∠ is the argument operator to compute the angle of c[b]. It should be noted that in case of smoothing of the cross-spectrum, $c_{sm}[b,i]$ is used for IPD calculation as $$\mathrm{IPD}[b]=\angle c_{sm}[b,i]$$

In the third step, the parameter generator 405 calculates ITDs of each frequency bin (or sub-band) based on IPDs.

$$ITD[b]=\frac{IPD[b]N}{\pi b}$$

where N is the number of FFT bin.

In the fourth step, the parameter generator 405 performs counting of positive and negative values of ITD. The mean and standard deviation of positive and negative ITD are based on the sign of ITD as follows:

$$ITD_{mean_pos}=\frac{\sum_{i=0}^{i=M}ITD(i)}{Nb_{pos}}\quad\text{where } ITD(i)\geq 0$$

$$ITD_{mean_neg}=\frac{\sum_{i=0}^{i=M}ITD(i)}{Nb_{neg}}\quad\text{where } ITD(i)<0$$

$$ITD_{std_pos}=\sqrt{\frac{\sum_{i=0}^{i=M}(ITD(i)-ITD_{mean_pos})^2}{Nb_{pos}}}\quad\text{where } ITD(i)\geq 0$$

$$ITD_{std_neg}=\sqrt{\frac{\sum_{i=0}^{i=M}(ITD(i)-ITD_{mean_neg})^2}{Nb_{neg}}}\quad\text{where } ITD(i)<0$$

where $Nb_{pos}$ and $Nb_{neg}$ are the number of positive and negative ITD respectively. M is the total number of ITDs which are extracted.

In the fifth step, the parameter generator 405 selects ITD from positive and negative ITD based on the mean and standard deviation. The selection algorithm is shown in FIG. 3.

In an implementation form, the parameter generator 405 comprises:

a frequency transformer such as a Fourier transformer, for determining a frequency transform ($X_1[k]$) of the audio channel signal values ($x_1[n]$) of the audio channel signal ($x_1$) and for determining a frequency transform ($X_2[k]$) of reference audio signal values ($x_2[n]$) of a reference audio signal ($x_2$), wherein the reference audio signal is another audio channel signal ($x_2$) of the plurality of audio channel signals or a down-mix audio signal derived from at least two audio channel signals ($x_1$, $x_2$) of the plurality of audio channel signals;

an inter channel difference determiner for determining inter channel differences (IPD[b], ITD[b]) for at least each frequency sub-band (b) of a subset of frequency sub-bands, each inter channel difference indicating a phase difference (IPD[b]) or time difference (ITD[b]) between a band-limited signal portion of the audio channel signal and a band-limited signal portion of the reference audio signal in the respective frequency sub-band (b) the inter-channel difference is associated to;

an average determiner for determining a first average ($ITD_{mean_pos}$) based on positive values of the inter-channel differences (IPD[b], ITD[b]) and for determining a second average ($ITD_{mean_neg}$) based on negative values of the inter-channel differences (IPD[b], ITD[b]); and an encoding parameter determiner for determining the encoding parameter (ITD) based on the first average and on the second average.

Figure 5:
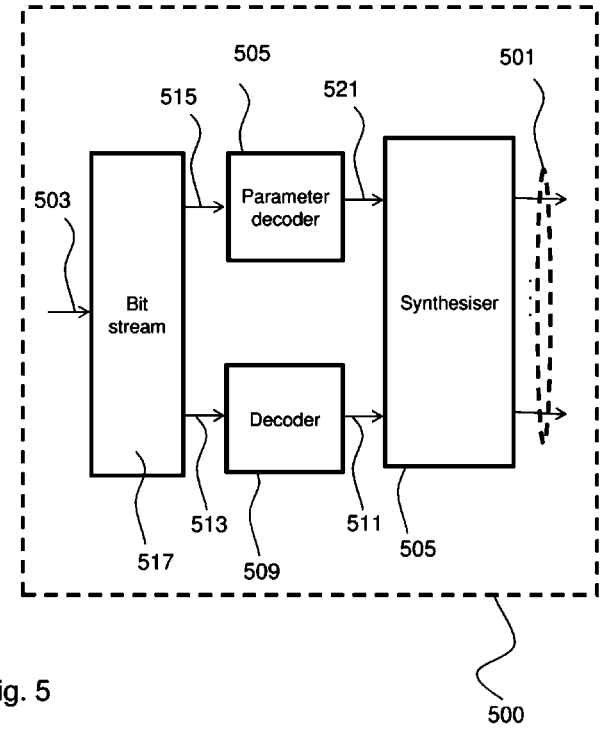
FIG. 5 shows a block diagram of a parametric audio decoder according to an implementation form.

FIG. 5 shows a block diagram of a parametric audio decoder 500 according to an implementation form. The parametric audio decoder 500 receives a bit stream 503 transmitted over a communication channel as input signal and provides a decoded multi-channel audio signal 501 as output signal. The parametric audio decoder 500 comprises a bit stream decoder 517 coupled to the bit stream 503 for decoding the bit stream 503 into an encoding parameter 515 and an encoded signal 513, a decoder 509 coupled to the bit stream decoder 517 for generating a sum signal 511 from the encoded signal 513, a parameter resolver 505 coupled to the bit stream decoder 517 for resolving a parameter 521 from the encoding parameter 515 and a synthesizer 505 coupled to the parameter resolver 505 and the decoder 509 for synthesizing the decoded multi-channel audio signal 501 from the parameter 521 and the sum signal 511.

The parametric audio decoder 500 generates the output channels of its multi-channel audio signal 501 such that ICTD, ICLD, and/or ICC between the channels approximate those of the original multi-channel audio signal. The described scheme is able to represent multi-channel audio signals at a bitrate only slightly higher than what is required to represent a mono audio signal. This is so, because the estimated ICTD, ICLD, and ICC between a channel pair contain about two orders of magnitude less information than an audio waveform. Not only the low bitrate but also the backwards compatibility aspect is of interest. The transmitted sum signal corresponds to a mono down-mix of the stereo or multi-channel signal.

Figure 6:
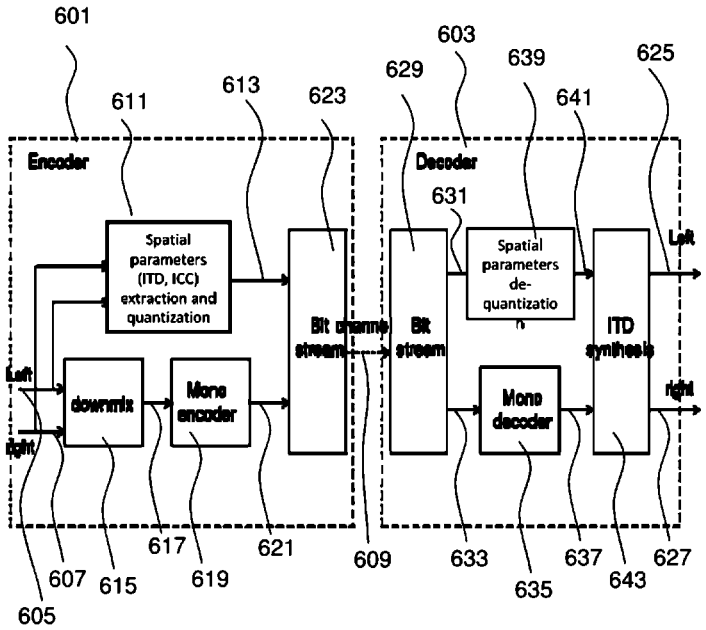
FIG. 6 shows a block diagram of a parametric stereo audio encoder and decoder according to an implementation form.
Figure 7:
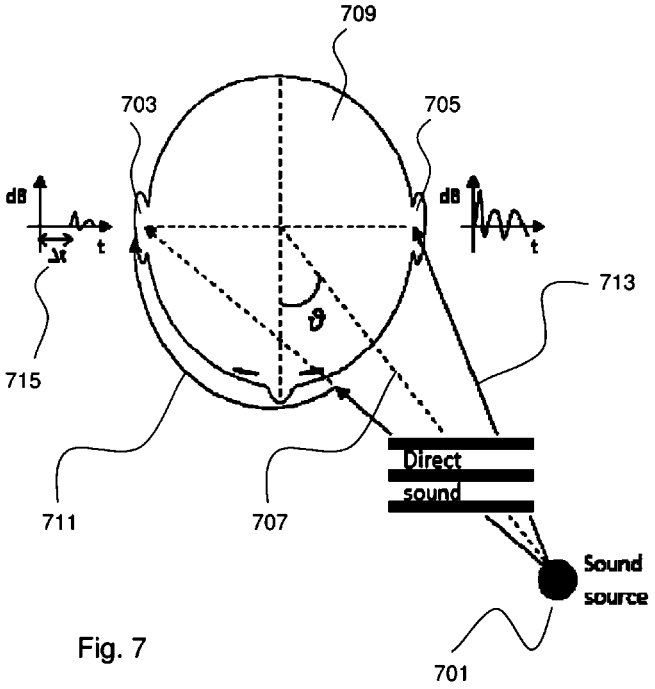
FIG. 7 shows a schematic diagram illustrating the principles of inter-aural time differences.

FIG. 6 shows a block diagram of a parametric stereo audio encoder 601 and decoder 603 according to an implementation form. The parametric stereo audio encoder 601 corresponds to the parametric audio encoder 400 as described with respect to FIG. 4, but the multi-channel audio signal 401 is a stereo audio signal with a left 605 and a right 607 audio channel.

The parametric stereo audio encoder 601 receives the stereo audio signal 605, 607 as input signal and provides a bit stream as output signal 609. The parametric stereo audio encoder 601 comprises a parameter generator 611 coupled to the stereo audio signal 605, 607 for generating spatial parameters 613, a down-mix signal generator 615 coupled to the stereo audio signal 605, 607 for generating a down-mix signal 617 or sum signal, a mono encoder 619 coupled to the down-mix signal generator 615 for encoding the down-mix signal 617 to provide an encoded audio signal 621 and a bit stream combiner 623 coupled to the parameter generator 611 and the mono encoder 619 to combine the encoding parameter 613 and the encoded audio signal 621 to a bit stream to provide the output signal 609. In the parameter generator 611 the spatial parameters 613 are extracted and quantized before being multiplexed in the bit stream.

The parametric stereo audio decoder 603 receives the bit stream, i.e. the output signal 609 of the parametric stereo audio encoder 601 transmitted over a communication channel, as an input signal and provides a decoded stereo audio signal with left channel 625 and right channel 627 as output signal. The parametric stereo audio decoder 603 comprises a bit stream decoder 629 coupled to the received bit stream 609 for decoding the bit stream 609 into encoding parameters 631 and an encoded signal 633, a mono decoder 635 coupled to the bit stream decoder 629 for generating a sum signal 637 from the encoded signal 633, a spatial parameter resolver 639 coupled to the bit stream decoder 629 for resolving spatial parameters 641 from the encoding parameters 631 and a synthesizer 643 coupled to the spatial parameter resolver 639 and the mono decoder 635 for synthesizing the decoded stereo audio signal 625, 627 from the spatial parameters 641 and the sum signal 637.

The processing in the parametric stereo audio decoder 603 is able to introduce delays and modify the level of the audio signals adaptively in time and frequency to generate the spatial parameters 631, e.g., inter-channel time differences (ICTDs) and inter-channel level differences (ICLDs). Furthermore, the parametric stereo audio decoder 603 performs time adaptive filtering efficiently for inter-channel coherence (ICC) synthesis. In an implementation form, the parametric stereo encoder uses a short time Fourier transform (STFT) based filter-bank for efficiently implementing binaural cue coding (BCC) schemes with low computational complexity. The processing in the parametric stereo audio encoder 601 has low computational complexity and low delay, making parametric stereo audio coding suitable for affordable implementation on microprocessors or digital signal processors for real-time applications.

The parameter generator 611 depicted in FIG. 6 is functionally the same as the corresponding parameter generator 405 described with respect to FIG. 4, except that quantization and coding of the spatial cues has been added. The sum signal 617 is coded with a conventional mono audio coder 619. In an implementation form, the parametric stereo audio encoder 601 uses an STFT-based time-frequency transform to transform the stereo audio channel signal 605, 607 in frequency domain. The STFT applies a discrete Fourier transform (DFT) to windowed portions of an input signal x(n). A signal frame of N samples is multiplied with a window of length W before an N-point DFT is applied. Adjacent windows are overlapping and are shifted by W/2 samples. The window is chosen such that the overlapping windows add up to a constant value of 1. Therefore, for the inverse transform there is no need for additional windowing. A plain inverse DFT of size N with time advance of successive frames of W/2 samples is used in the decoder 603. If the spectrum is not modified, perfect reconstruction is achieved by overlap/add.

As the uniform spectral resolution of the STFT is not well adapted to human perception, the uniformly spaced spectral coefficients output of the STFT are grouped into B non-overlapping partitions with bandwidths better adapted to perception. One partition conceptually corresponds to one "sub-band" according to the description with respect to FIG. 4. In an alternative implementation form, the parametric stereo audio encoder 601 uses a non-uniform filter-bank to transform the stereo audio channel signal 605, 607 in frequency domain.

In an implementation form, the downmixer 315 determines the spectral coefficients of one partition b or of one sub-band b of the equalized sum signal Sm(k) 617 by $$S_m(k) = e_b(k)\sum_{c=1}^{C} X_{c,m}(k),$$

where Xc,m(k) are the spectra of the input audio channels 605, 607 and eb(k) is a gain factor computed as $$e_b(k) = \sqrt{\frac{\sum_{c=1}^{C} p_{\tilde{x}_{e,b}}(k)}{p_{\tilde{x}_b}(k)}},$$

with partition power estimates, $$p_{\tilde{x}_{c,b}}(k) = \sum_{m=A_{b-1}}^{A_b-1} |X_{c,m}(k)|^2$$

$$p_{\tilde{x}_b}(k) = \sum_{m=A_{b-1}}^{A_b-1} \left| \sum_{c=1}^{C} X_{c,m}(k) \right|^2 .$$

To prevent artifacts resulting from large gain factors when attenuation of the sum of the sub-band signals is significant, the gain factors eb(k) are limited to 6 dB, i.e. eb(k)<2.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

The present disclosure also supports a system configured to execute the performing and computing steps described herein.

Many alternatives, modifications, and variations will be apparent to those skilled in the art in light of the above teachings. Of course, those skilled in the art readily recognize that there are numerous applications of the present disclosure beyond those described herein. While the present invention has been described with reference to one or more particular embodiments, those skilled in the art recognize that many changes may be made thereto without departing from the spirit and scope of the present invention. It is therefore to be understood that within the scope of the appended claims and their equivalents, the inventions may be practiced otherwise than as specifically described herein.

What is claimed is:

1. A method for determining an encoding parameter for an audio channel signal of a plurality of audio channel signals of a multi-channel audio signal, each audio channel signal having audio channel signal values, the method comprising:

determining a frequency transform of the audio channel signal values of the audio channel signal;

determining a frequency transform of reference audio signal values of a reference audio signal, wherein the reference audio signal is another audio channel signal of the plurality of audio channel signals or a downmix audio signal derived from at least two audio channel signals of the plurality of audio channel signals;

determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band that the inter-channel difference is associated with;

determining a first average based on positive values of the inter-channel differences and determining a second average based on negative values of the inter-channel differences; and determining the encoding parameter based on the first average and on the second average.

2. The method of claim 1, wherein the inter-channel differences are inter-channel phase differences or inter channel time differences.

3. The method of claim 1, further comprising:

determining a first standard deviation based on the positive values of the inter-channel differences and determining a second standard deviation based on the negative values of the inter-channel differences, wherein the determining the encoding parameter is based on the first standard deviation and on the second standard deviation.

4. The method of claim 1, wherein a frequency sub-band comprises one or a plurality of frequency bins.

5. The method of claim 1, wherein the determining the inter channel differences for at least each frequency sub-band of the subset of the frequency sub-bands comprises:

determining a cross-spectrum as a cross correlation from the frequency transform of the audio channel signal values and the frequency transform of the reference audio signal values; and determining inter channel phase differences for each frequency sub band based on the cross spectrum.

6. The method of claim 5, wherein an inter channel phase difference of a frequency bin or of a frequency sub-band is determined as an angle of the cross spectrum.

7. The method of claim 5, further comprising:

determining inter-channel time differences based on the inter channel phase differences; wherein the determining the first average is based on positive values of the inter-channel time differences and the determining the second average is based on negative values of the inter-channel time differences.

8. The method of claim 6, wherein an inter-channel time difference of a frequency sub-band is determined as a function of the inter channel phase difference, the function depending on a number of frequency bins and on the frequency bin or frequency sub-band index.

9. The method of claim 7, wherein the determining the encoding parameter comprises:

counting a first number of positive inter-channel time differences and a second number of negative inter-channel time differences over the number of frequency sub-bands comprised in the sub-set of the frequency sub-bands.

10. The method of claim 9, wherein the encoding parameter is determined based on a comparison between the first number of the positive inter-channel time differences and the second number of the negative inter-channel time differences.

11. The method of claim 10, wherein the encoding parameter is determined based on a comparison between the first standard deviation and the second standard deviation.

12. The method of claim 10, wherein the encoding parameter is determined based on a comparison between the first number of the positive inter-channel time differences and the second number of the negative inter-channel time differences multiplied by a first factor.

13. The method of claim 12, wherein the encoding parameter is determined based on a comparison between the first standard deviation and the second standard deviation multiplied by a second factor.

14. A multi-channel spatial audio encoder for determining an encoding parameter for an audio channel signal of a plurality of audio channel signals of a multi-channel audio signal, each audio channel signal having audio channel signal values, the multi-channel spatial audio encoder comprising:

a frequency transformer, configured to determine a frequency transform of the audio channel signal values of the audio channel signal, and configured to determine a frequency transform of reference audio signal values of a reference audio signal, wherein the reference audio signal is another audio channel signal of the plurality of audio channel signals or a downmix audio signal derived from at least two audio channel signals of the plurality of audio channel signals;

an inter channel difference determiner, configured to determine inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band that the inter-channel difference is associated with;

an average determiner, configured to determine a first average based on positive values of the inter-channel differences, and configured to determine a second average based on negative values of the inter-channel differences; and an encoding parameter determiner, configured to determine for determining the encoding parameter based on the first average and on the second average.

15. The multi-channel spatial audio encoder of claim 14, wherein the frequency transformer is a Fourier transformer.

16. The multi-channel spatial audio encoder of claim 14, wherein the inter channel difference determiner comprises one or more processors.

17. The multi-channel spatial audio encoder of claim 14, wherein the average determiner comprises one or more processors.

18. The multi-channel spatial audio encoder of claim 14, wherein the encoding parameter determiner comprises one or more processors.

19. A computer product for determining an encoding parameter for an audio channel signal of a plurality of audio channel signals of a multi-channel audio signal, each audio channel signal having audio channel signal values, comprising a processor and a non-transitory processor-readable medium having processor-executable instructions stored thereon, which when executed, causes the processor to implement:

determining a frequency transform of the audio channel signal values of the audio channel signal;

determining a frequency transform of reference audio signal values of a reference audio signal, wherein the reference audio signal is another audio channel signal of the plurality of audio channel signals or a downmix audio signal derived from at least two audio channel signals of the plurality of audio channel signals;

determining inter channel differences for at least each frequency sub-band of a subset of frequency sub-bands, each inter channel difference indicating a phase difference or time difference between a band-limited signal portion of the audio channel signal and a band-limited signal portion of the reference audio signal in the respective frequency sub-band that the inter-channel difference is associated with;

determining a first average based on positive values of the inter-channel differences and determining a second average based on negative values of the inter-channel differences; and determining the encoding parameter based on the first average and on the second average.

20. The computer product of claim 19, wherein the processor further implements:

determining a first standard deviation based on the positive values of the inter-channel differences and determining a second standard deviation based on the negative values of the inter-channel differences, wherein the determining the encoding parameter is based on the first standard deviation and on the second standard deviation.

* * * * *